US006916263B1

(12) United States Patent
Pacheco

(10) Patent No.: US 6,916,263 B1
(45) Date of Patent: Jul. 12, 2005

(54) COVER FOR A BALL OR SPHERE

(75) Inventor: Francisco Pacheco, Heredia (CR)

(73) Assignee: Seesaw Industries, Ltd., Alexandria, VA (US)

( * ) Notice: Subject to any disclaimer, the term of this patent is extended or adjusted under 35 U.S.C. 154(b) by 0 days.

(21) Appl. No.: 10/398,405

(22) PCT Filed: Oct. 10, 2000

(86) PCT No.: PCT/CR00/00003

§ 371 (c)(1),
(2), (4) Date: Apr. 7, 2003

(87) PCT Pub. No.: WO02/30522

PCT Pub. Date: Apr. 18, 2002

(51) Int. Cl.[7] ..... A63B 41/08
(52) U.S. Cl. ..... 473/607; 473/599
(58) Field of Search ..... 473/603–605, 473/607, 612, 598, 599, 596; D21/709, 713

(56) References Cited

U.S. PATENT DOCUMENTS 1,299,092 A * 4/1919 Abrahamson ..... 473/595
5,820,501 A * 10/1998 Soofi ..... 473/599

FOREIGN PATENT DOCUMENTS

FR 2442644 * 12/1977

* cited by examiner

*Primary Examiner*—Steven Wong
(74) *Attorney, Agent, or Firm*—Sherman & Shalloway

(57) ABSTRACT

A ball for ball games, organized in 18 squares and adjusted by 8 helices, wherein the ideal sphericity is obtained when the distance from the center (Y) to the corners of the triangle in the center of the helix is equal to the difference in distance that exists between the square and its diagonal: If c=sqrt(3) *(d−a) and d=⅛C, then sphere.

11 Claims, 6 Drawing Sheets

COVER FOR A BALL OR SPHERE

BACKGROUND OF THE INVENTION

The field of this invention refers to the construction of spherical surfaces through the distribution of a group of polygons. The sports balls industry is one of the technical sectors that is most interested in the design of spherical schemes for its products. In particular, soccer needs a ball with a high degree of sphericity and one that is well balanced, so that the player will be assured that the ball will react in accordance with the way he hits the ball.

The history of soccer presents a constant improvement in the design of the balls. Initially they used surfaces of 12 panels, that were eventually deformed with time and use. Then the current ball was introduced with 32 pieces (12 pentagons and 20 hexagons), described by Arquemedes as one of the thirteen semi regular polyhedrons. Lately the market offers balls that go from 6 to 42 pieces, two stand out since they outdo the balance and sphericity of the traditional design: EP 0383 714 and WO 94/03239.

SUMMARY OF THE INVENTION

The present invention provides an inflatable ball for ball games comprising: a circumference with a selected measurement (C); a surface having a number of interconnected basic panels comprising eighteen squares, twenty four trapezoids and eight equilateral triangles, the squares having four sides of substantially equal length (a) and two corresponding diagonals of length (d), the triangles having three sides of a substantially equal length (c) and a central point (Y) and the trapezoids having four sides composed of two legs of length (a), one base of length (a) and a smaller side of length (c). The trapezoids are enclosed by three of the squares and one of the triangles, wherein the sides (c) of the trapezoids are connected to the sides (c) of the equilateral triangles and the sides (a) of the trapezoids are connected to the sides (a) of the squares. The relation of the circumference measurement (C) with the length (c) ranges between a first ratio of (c)=6.436% (C) and a second ratio of (c)=6.25% (C) and the length (d) of the diagonals of the squares are substantially equal to one eighth of the measurement (C).

The present invention further provides an adjustable flexible structure comprising: an adjustable surface comprising a plurality of interconnected frames consisting of eighteen squares, twenty four trapezoids and eight equilateral triangles, the square frames having four sides of normally equal length (a), the triangular frames having three sides of adjustable measurement ranging between the length (a) and a shorter length (c), the trapezoid frames having four sides wherein three of the sides have a normally equal length (a) and the fourth side has an adjustable measurement ranging between the length (a) and the shorter length (c). The adjustable sides of the triangular frames are connected to the adjustable sides of the trapezoid frames and the normally equal length sides of the trapezoids are connected to the normally equal length sides of the squares. Also provided are means for adjusting the adjustable sides of the triangles and the trapezoids to a selected measurement ranging between the length (a) and the shorter length (c).

DESCRIPTION

Figure 1A:
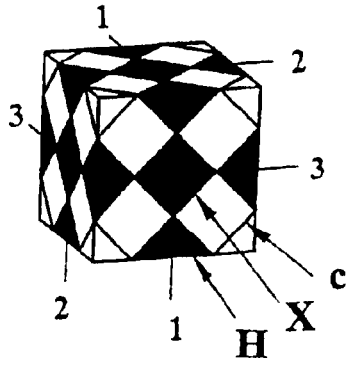
FIGS. 1A & B present a cubic representation of a ball according to the present invention.

The square and the triangle make up the sphere: Cut 6 strings with the same length as circumference C; 15 divide the six strings in two, three times, in order to obtain a total of 48 segments; put 36 apart and divide the other 12 in two, in order to have 24; with the 36 pieces form 18 crosses and with the 24 pieces form 8 triangles; with the 18 crosses make 3 interbedded rings of 8 crosses each; 6 of the crosses are the intersections of two rings and the other 12 crosses have two of their ends free; the 8 groups of 3 ends that are free and next to each other, should hold the 8 equilateral triangles by its corners.

The decomposition of the sphere seems not to have an exact solution. In the non symmetric schemes, the modifications that are carried out in the polygons to adjust the measurements of the circumference solve the calculation in one direction but at the same time affect it in another. In the symmetrical proposals the problem can be solved to a certain point, since you have to use an exhaustive method for the reduction of the size of the pieces in order to improve the sphericity.

The present invention offers a simple and exact solution for the construction of the spherical surface. The scheme is symmetric, but the exhaustive method is not required to find the solution, since the number of pieces is reduced. The drawing is made up of basic figures of elemental geometry-square and equilateral triangle.

The adjustment of 8 equilateral triangles (c) goes from c=6.44% to c=6.25% in relation to the 30 circumference (C). The simplest scheme presents itself when c=½d=6.25% C, since it allows you to build an almost perfect sphere with only knowing how to divide by two and it refers to the case of the strings described at the beginning. Now we will present other more exact schemes and how to calculate them.

Scheme C1=C2:

The structural base of the sphere is the cube. We will call the sides of the cube (A), the diagonals of the 35 cube (D) and we will determine three perimeters or circumferences (C):

C1: The shortest one, measured on the sides and it equals 4A.

C2; The longest one, drawn on the diagonals and it equals 2A+2D.

C3:An undulating strip that divides the cube in two and passes through all its faces and its measurement is 3D (you will see it in detail further on).

Figure 1B:
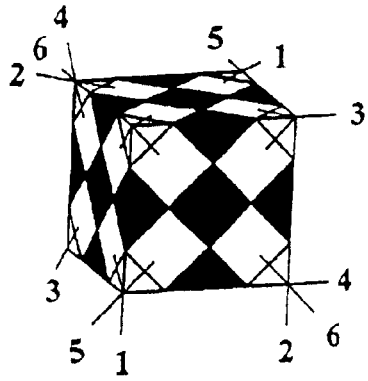

To measure C1 there are three alternatives (FIG. 1A) and for C2 there are six (FIG. 1B). The objective is to reduce the corners of the cube until you form a sphere, that is equivalent to cutting the greatest distance C2 down to the smallest circumference C1.

We will call the faces of the cube big squares and the small squares will be those drawn inside the faces. The distribution of the small squares (a) within the big squares (A), is described as follows: five whole ones forming a cross, four halves turn the cross into a non regular octagon and four fourths are added to the ends of the cross to give the big square its form.

Summary of Initial Formulas

| Big square | Small square: | Circumference C: |
|---|---|---|
| A = 2d | d = 1/8C | C1 = 8d = 4A |
| D = 4a | a = 1/8C/sqrt(2) = d/sqrt(2) | C2 = 8a + 4d = 2D + 2A |

The squared cube (FIG. 1), is made up of 48 small squares, 18 black and 30 white (24 whole ones and 6 in the corners). We will call the central squares of each face (X) and the rest of the black squares that surround them will be called (H). We will call the segment that joins the ¼ of the white corner square with its neighbor white square (c), and the corners of the cube will be named (Y).

We will consider the black pieces as the inalterable surface of the sphere and the white ones as the empty space subject to modifications. C1 is made up of 8 black pieces (4X and 4H) in its three directions (FIG. 1A). C2 is made up of black and white interbedded pieces. We have to find the way to reduce C2 down to C1 modifying only the white pieces.

The solution is to diminish the size of (c). First you have to eliminate the eight corners of the cube along (c) and form 8 new faces in the cube (the total surface is now made up of 6 non regular octagons and 8 equilateral triangles). The corners (Y) that we cut off are now located in the center of the equilateral triangles (c). For the moment c=a, but in order to form the sphere, (c) has to be reduced down to almost c=½d.

Description of the equilateral triangle (c): The height (h) is calculated by h=sqrt(cc−(½c)*(½c))=sqrt(¾cc)=½c*sqrt(3). The vertices (T) are the ends of (c), (B) divides (c) in two and (Y) is the center of the triangle, so BY=⅓h and YT=⅔h. When you reduce (c) the white squares neighboring the triangle become trapezoids made up of three sides (a), one side (c) and one height (b). This new figure can be described as a rectangle (bc) and two triangles (abe), since a−c=2e. The introduction of the trapezoids and the equilateral triangles, establishes a new formula for the circumference C2=2a+4b+4h+2d.

Figure 4:
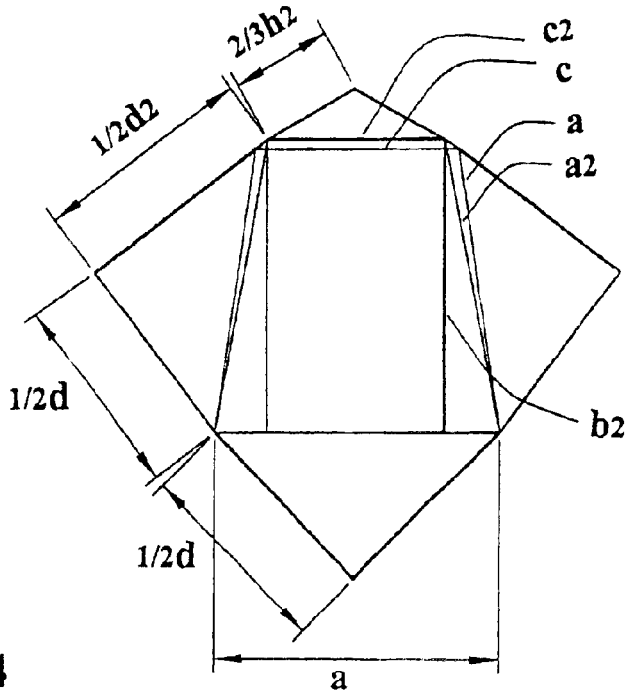
FIG. 4 presents the basic kite figure from which the elements of the present invention are derived.
Figure 8A:
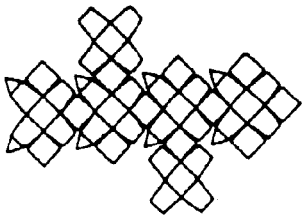
FIGS. 8A–L illustrate alternative distributions of panels obtained following the present invention from which the cover is made.
Figure 8B:
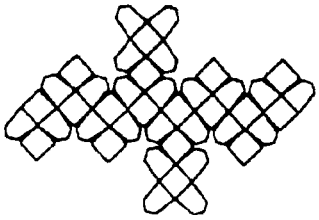
Figure 8C:
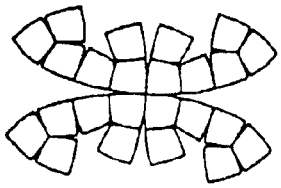
Figure 8D:
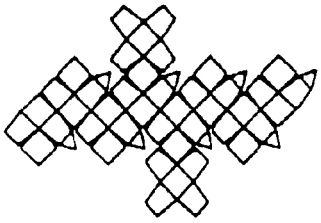
Figure 8E:
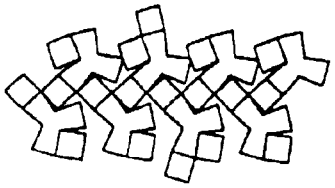
Figure 8F:
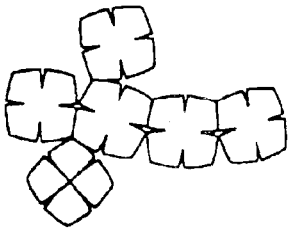
Figure 8G:
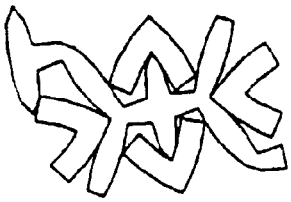
Figure 8H:
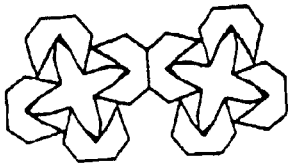
Figure 8I:
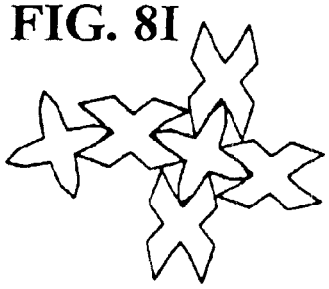
Figure 8J:
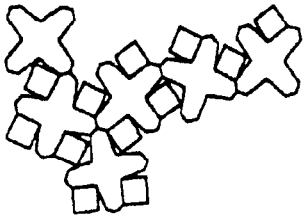
Figure 8K:
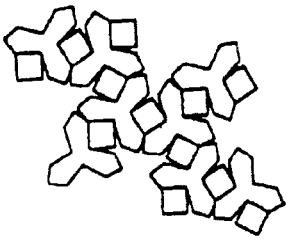
Figure 8L:
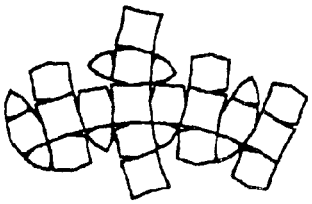

The distribution of the panels that make up the proposed cover for the ball, is described as follows: 18 small squares (a), 8 equilateral triangles (c) and 24 trapezoids (made up by the rectangle (ab) and two triangles (abe)) (FIGS. 8A and D). The joining of the neighboring pieces reduces the cuts to 42 panels: 18 squares (a) and 24 pointed trapezoids formed by the union of the rectangle (ab), the two triangles (abe) and one third of the equilateral triangle (c) (FIG. 8B). You can simplify it to 26 panels: three pointed trapezoids form a three cross helix/propeller to obtain 18 squares and 8 helices (FIG. SE). Another alternative consists in redistributing the pieces to form 24 identical panels: the union of a trapezoid with ¼ of a square in its 3 sides (a) and ⅓ of an equilateral triangle in its side (c) to form a kite (FIGS. 4, 8C). When you join 5 kites in the squares (X) you obtain 6 similar pieces, one for each face of the cube (FIG. 8F).

Figure 2:
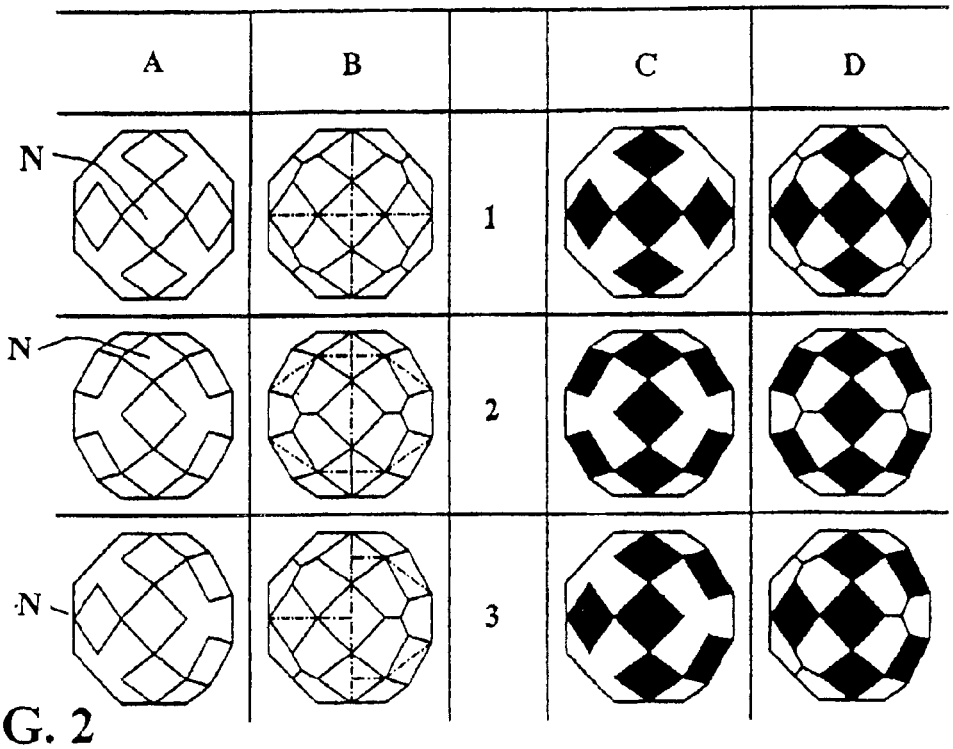
FIG. 2 presents views of a ball derived from the cubic representations of FIGS. 1A & B where row 1 is a frontal view, row 2 is a lateral view and row 3 is a bipolar view.

FIG. 2 shows different views of the ball. The two top rows show the 26 and 42 panel versions, with and without color. The first row represents the big square of the cube, the second row represents the view of one of the vertices of the cube and the third row refers to the bipolar model (cut the sphere in any C1 and move the black squares in one position). In column A, the (N) signals the same panel in different angles and in column B, the dotted line marks the three circumferences C1.

Summary of Additional Formulas

| | |
|---|---|
| h = 1/2c*sqrt(3) | BY = 1/3h |
| e = 1/2(a−c) | YT = 2/3h |
| b = sqrt(aa−ee) | C2 = 2a + 4b + 4h + 2d |

From the initial formulas we know that d=⅛C1 and a=d/sqrt(2) and from the new formulas we know that 15 (h), (e) and (b) depend on (c). So (a) and (d) together with the variable (c), allows us to determine that C2 equals C1 when c=6.43604307 . . . % C1.

Given the symmetry of the scheme, the equality C1=C2 is obtained in nine different directions (3 for C1 and 6 for C2), which assures, a good measurement of the sphericity of the figure. Notwithstanding, the introduction of the circumference C3 allows for a better adjustment.

Figure 3A:
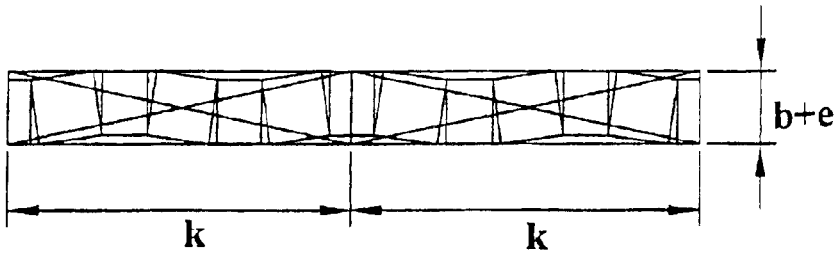
FIGS. 3A & B illustrate an ecliptic belt of the ball of the present invention, with FIG. 3B representing an enlargement of a portion of FIG. 3A.
Figure 3B:
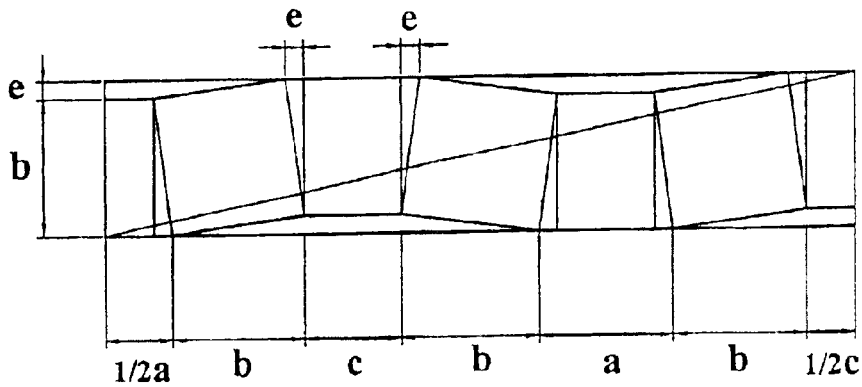

Scheme C3=C1=C2:

Before we had said that C3s an undulating strip that measures 3D (12a=3D). In the cube there are four of these rings and each one passes through the 6 faces of the cube, covering all the surface except for the squares (X) and the corners (Y). The strip that forms each ring has a length of 12 squares (a) and a width of (a). When you reduce (c), the trapezoids turn the ring into a sort of serpent or a double "s", that we will call ecliptic. The ecliptic has a length of 2k=6b+3a+3c and a width of b+e (FIG. 3A & B).

The measurement C3 is calculated as two times the diagonal of half a strip: C3=2*sqrt(k*k+(b+e)*(b+e)). This calculation is due to fact that the ecliptic crosses through the circumference twice. The intertwined complex of the four ecliptics gives the sphere its form. Before we calculated that C1=C2 when c=6.43% C1 and know we can calculate that C3=C1 when c=6.322424% C1.

Figure 5:
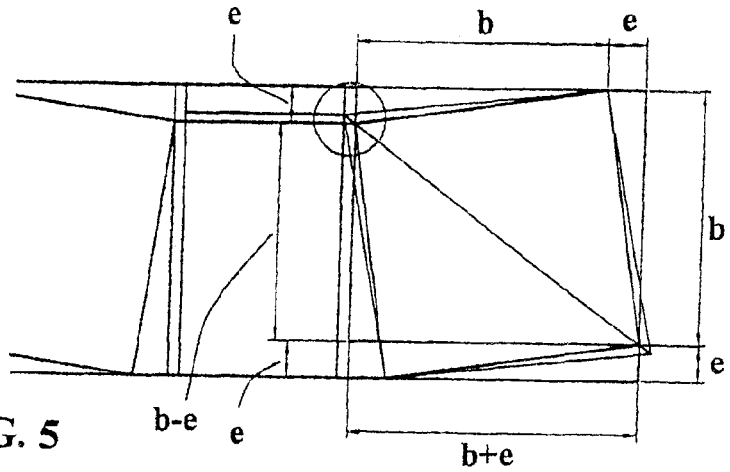
FIG. 5 is an enlargement of FIG. 3B illustrating the transformation of a square into a rhombus.

This seems to indicate that the equality C1=C2=C3 is impossible. But it has a solution: We must maintain the width and length of the ecliptic and smooth down the curves. You can achieve this with a small modification that turns the squares (H) in rhombuses and shortens (c) without loosing the slope of the diagonal (d) (FIGS. 4, 5).

Figure 6:
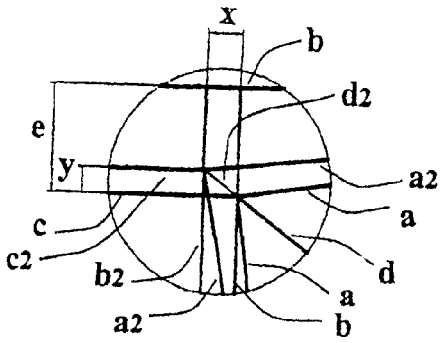
FIG. 6 is an enlargement of one corner in FIG. 5.
Figure 7A:
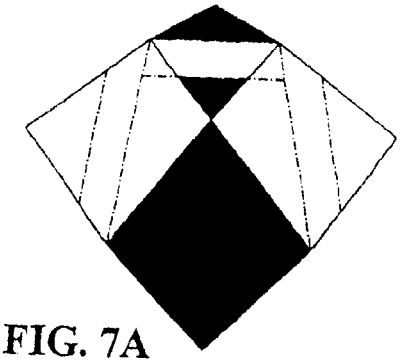
FIGS. 7A and B illustrate the kite of FIG. 4 highlighted in alternating patterns.
Figure 7B:
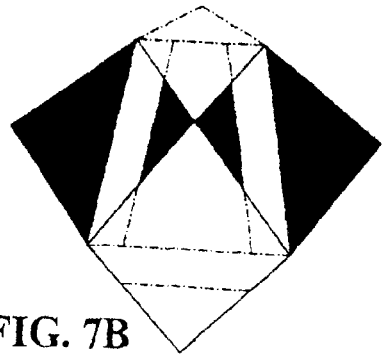

The diagonal (d2) of the square (H) stretches when you shorten (c) and the other diagonal (d) of the square (H) stays fixed, forming the rhombus. With the rhombuses the segments (d), (c), (b), (h), and (a) become (d2), (c2), (b2), (h2), and (a2). (FIG. 6).

The operation we just described works because in C2, the increases of 4b and 2d are greater than the decreases in 4h. The point of equality is given when c=5.521399% C1.

Scheme c=sqrt(3)*(d−a):

In the preceding solution, the rhombuses resolve the gap between 6.43 . . . % and 6.32 . . . % that avoids the equality between C2 and C3. Notwithstanding, the alternative that we now propose wants to take advantage of the said gap.

We are referring to the special case c=sqrt(3)*(d−a), where h=½c*sqrt(3)=⅜(d−a). We know that if C1=8d and C2=2a+4b+4h+2d, then 6d=2a+4b+4h. If for one moment we suppose that a=b, the formula would read 6d=6a+4h, simplifying h=⅜(d−a). Notwithstanding, we know that this supposition is impossible because it would be true only in the case of the cube a=b so from the moment that we reduced c to forrn the trapezoid, the measurement of (b) will be less than (a).

The reasoning we just described suggests that there is a close relation between the differences (C1−C2), (d−a) and (a−b) and all these has to do with the transformation of a cube into a sphere. Keeping this in mind and going back to the formulas for C1 and C2, where h=⅜(d−a) and d=a*sqrt (2), we can determine that:

If, C2=2a+4b+4h+2a*sqrt(2), C1=8a*sqrt(2) and 4h=6a*sqrt(2)

then, C1−C2=4(a−b).

So when c=sqrt(3)*(d−a) we are before a special case: the difference C1−C2 is exactly four times the difference a−b; the distance C3−C1 is minimum (near 0.06%) and the coefficient c/C=6.3413 . . . % C1 is within the gap.

Figure 11A:
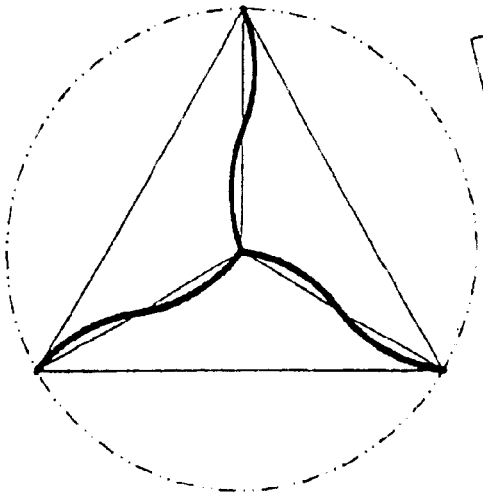
FIGS. 11A and B illustrate the "s" patterns at the union of each kite to resolve C1=C2=C3 when c=3×(d−a).
Figure 11B:
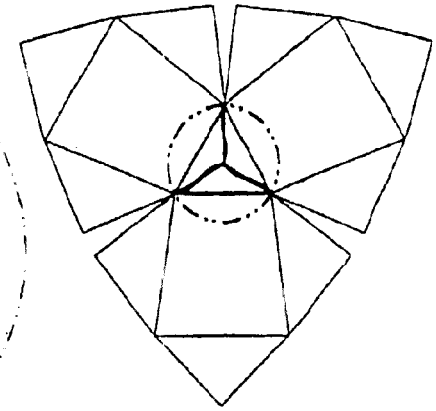

Everything suggests that it is within the equilateral triangles that the dilemma can be solved, since we do not want to modify the squares or the difference (a−b). Remember that in the equilateral triangle BY=⅓h and YT=⅔h and in this particular case BY=½(d−a) and YT=(d−a). Like in C2 there are (4h) and the difference of the circumferences is 4(a−b), we can conclude that the increase in (h) must be of (a−b). But if we do not want to alter the rest, the increase must come from the center of the triangle (Y), creating a sort of vacuum, a whirlpool towards the outside or tear (FIGS. 11A & B).

If for one moment we imagine that from the 8 points (Y) we have increases (a−b) coming out in three 25 directions T, what will happen is that the diagonals of the 18 squares will immediately increase, since the increases in (⅔h) produce similar increases in d, given YT=(d−a), provoking a general increase in the sphere.

If we are looking for the sphericity and not the growth, what must happen is a balance. What happens can be described as a sort of pulsation where four of the (Y) go towards the center and the other four towards the outside. In the intermediate point of this pulsation, the sphere is at its best balance, since the total change of circumferences is zero.

Figure 9:
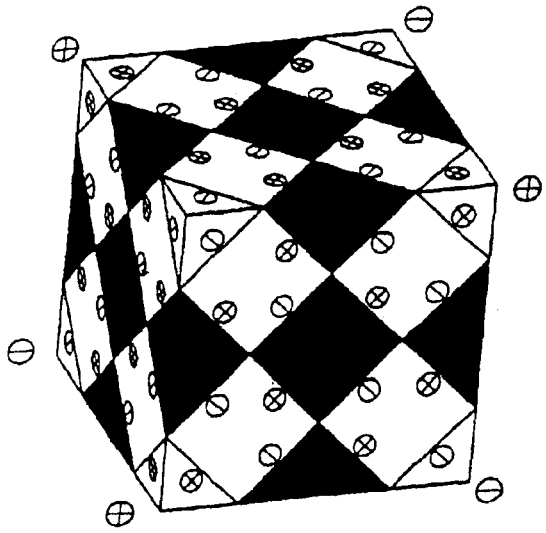
FIG. 9 illustrates the opposed orientation positions of "s" patterns of each of eight triangles of the ball.
Figure 10:
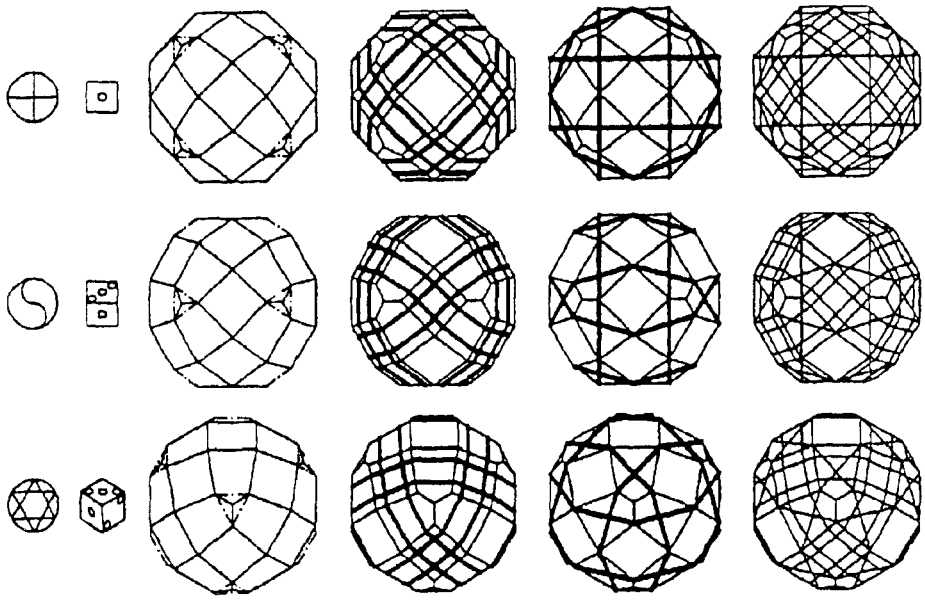
FIG. 10 illustrates frontal, lateral and isometric views of a ball according to the present invention.

We can imagine that every (Y) is a cogwheels that work with its other (Y) neighbors. One revolution in the (Y) of the North Pole creates a movement in the other 3 cogwheels of the Northern hemisphere and move the Equatorial line in the contrary direction. In the Southern hemisphere, other 3 cogwheels intertwined with those of the Northern hemisphere, push the Equatorial line in the same direction. The cogwheels can be seen in a magnetic way. The triangles (Y) have contrary charges in regards to their mirror image and to their 3 neighbors (Y). (FIG. 12) The charge in (H) and in (X) is divided by C1 (that is why (H) is divided in halves and (X) is divided in fourths.) The charge in each ½ of (H) is contrary to the charge in the nearest (Y) and the charge in each ¼ of (X) is similar to the charge in the nearest (Y) going through the trapezoid. (FIG. 9).

There are two groups of (4Y) of opposite polarity; while one group has a positive charge the other group has negative charge. With the formula c=sqrt(3)*(d−a) what intend is to give movement to the sphere in such a way that it can enter into orbit easily. This capacity is important in soccer. By crossing threads from a point (Y) that will come out through its mirror image (Y), the four strings cross each other in the nucleus. This mechanism allows the sphere to adjust its sphericity when it is hit. The threads that go to the nucleus can be made of steel or nylon or of any adequate material, they can have a flexible cover that prevents any contact with the bladders inside the ball. A less complex altemative is to cut the triangles in the form of a spiral in order to facilitate the balance of the ball. The curve that would be formed in (h) can be exaggerated until it has an adequate visual aspect. In this case the spirals of the triangles have to be sewed in two directions and in the adequate position of the cogwheel direction (FIGS. 11A & B and 12). This type of cut allows the triangle to stretch and shrink more easily (the same operation can be done in the diagonals of the squares).

Figure 12:
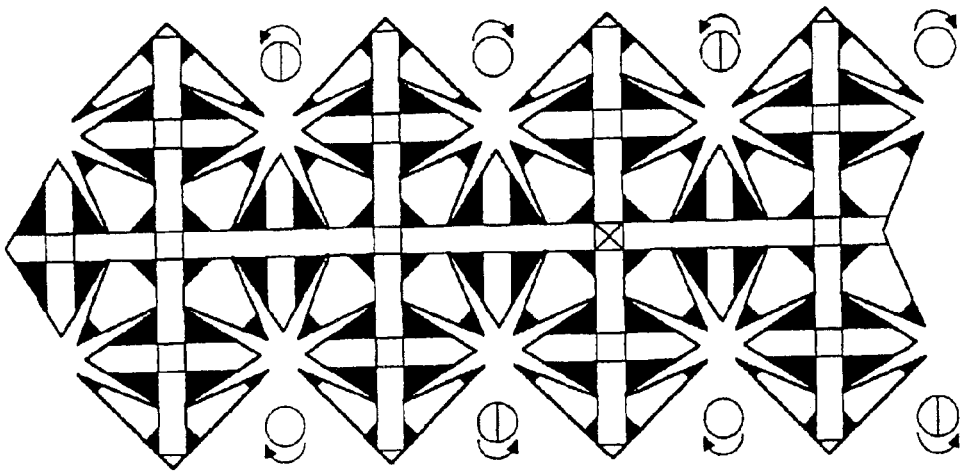
FIG. 12 illustrates a one piece scheme for the cover of a ball or sphere in accordance with the present invention.

A computer program with only the circumference can carry out the drawing of a one piece scheme (FIG. 12), and present options for different ornaments to be printed. The system is useful to decorate spheres in a faster way; ideal for the kids to be able to glue the paper on a sterophone ball and with a clip create their own christmas balls through internet. The one piece scheme is described as follows: 8 squares joined by their diagonals from the circumference C1, in an interlaced way the squares that form the other two circumferences come out of the squares 2, 4, 6, and 8, that form the string C1 (the first square is whole and the second one is ¼ of a square); at the union between the squares you leave a band wide enough for the sheet not to rip; since the measures of the spheres are known you can calculate the distances of the path that goes from the squares up to (y) (FIG. 12).

What is claimed is:

1. An inflatable ball for ball games comprising:

a circumference with a selected measurement (C);

a surface having a number of interconnected basic panels comprising eighteen squares, twenty four trapezoids and eight equilateral triangles, said squares having four sides of substantially equal length (a) and two corresponding diagonals of length (d), said triangles having three sides of a substantially equal length (c) and a central point (Y) and said trapezoids having four sides composed of two legs of said length (a), one base of said length (a) and a smaller side of said length (c);

said trapezoids being enclosed by three of said squares and one of said triangles, wherein said sides (c) of said trapezoids are connected to said sides (c) of said equilateral triangles and said sides (a) of said trapezoids are connected to said sides (a) of said squares; and the relation of said circumference measurement (C) with said length (c) ranging between a first ratio of (c)=6.436% (C) and a second ratio of (c)=6.25% (C) and said length (d) of said diagonals of said squares being substantially equal to one eighth of said measurement (C).

2. The ball of claim 1, wherein said length (c) of said triangles is equal to the difference between said length (d) and said length (a) multiplied by the square root of the number three: (c)=sqrt(3)×(d−a).

3. The ball of claim 1, wherein twelve of said squares have one of said diagonals of length (d) and the other of said diagonals of a length larger than (d), thereby forming twelve rhombuses, said longer diagonals being disposed between two of said triangles.

4. The ball of claim 1 further comprising subassemblies in the form of large panels formed from the union of selected groups of said basic panels.

5. The ball of claim 4 further comprising subassemblies in the form of small panels formed from subdivisions of selected groups of said basic panels.

6. The ball of claim 1 further comprising subassemblies in the form of small panels formed from subdivisions of selected groups of said basic panels.

7. The ball of claim 1 further comprising four diametral axes passing through the center of said ball, each axis having two opposed poles disposed at said points (Y), said triangles including three identical interconnected sub-triangles dividing each of said triangles, said three sub-triangles each comprising a base of said length (c) and two legs extending in an "s" pattern from each apex of said triangle to said central point (Y).

8. The ball of claim 7, wherein said "s" extensions of said legs of said sub-triangles are disposed in two opposed orientations, and further comprising a first group of four of said triangles having said sub-triangle legs of one orientation and a second group of four of said triangles having said sub-triangle legs of the other orientation, each triangle of said first group of triangles being disposed at one of said poles of said four diametral axes and each triangle of said second group of triangles being disposed at an opposed pole of said axes, whereby each axis has a triangle of said first group at one pole and a triangle of said second group at the opposite pole.

9. The ball of claim 1 further comprising at least four elongated support strings disposed between two of said points (Y), each of said strings crossing the others substantially near the absolute center of said ball.

10. The ball of claim 1 further comprising an ornamental design of at least eight concave cogwheels disposed at said points (Y).

11. The ball of claim 1 further comprising an ornamental design of at least twelve concave cogwheels disposed at the center of some of said squares.

* * * * *